US005589658A

United States Patent [19]

Sauvestre

[11] Patent Number: 5,589,658

[45] Date of Patent: Dec. 31, 1996

[54] SABOT WITH CONTROLLED SEPARATION OF THE ELEMENTS FOR SUBCALIBER PROJECTILES

[76] Inventor: Jean-Claude Sauvestre, 64 rue de la Vallée, 18230 Saint-Doulchard, France

[21] Appl. No.: 411,661

[22] PCT Filed: Aug. 5, 1994

[86] PCT No.: PCT/FR94/00984

§ 371 Date: Apr. 6, 1995

§ 102(e) Date: Apr. 6, 1995

[87] PCT Pub. No.: WO95/04913

PCT Pub. Date: Feb. 16, 1995

[30] Foreign Application Priority Data

Aug. 6, 1993 [FR] France ..... 93 09708

[51] Int. Cl.[6] ..... F42B 14/06

[52] U.S. Cl. ..... 102/521; 102/439

[58] Field of Search ..... 102/439, 520–523

[56] References Cited

U.S. PATENT DOCUMENTS

| | | | |
|---|---|---|---|
| 3,905,299 | 9/1975 | Feldman | 102/522 |
| 4,802,415 | 2/1989 | Clarke et al. | 102/521 |
| 4,911,079 | 3/1990 | Sauvestre | 102/521 |
| 5,182,419 | 1/1993 | Burnette | 102/523 |

FOREIGN PATENT DOCUMENTS

| | | |
|---|---|---|
| 86711 | 8/1983 | European Pat. Off. . |
| 2555728 | 5/1985 | France . |
| 2599828 | 12/1987 | France . |
| 2606500 | 5/1988 | France . |

*Primary Examiner*—Harold J. Tudor
*Attorney, Agent, or Firm*—Foley & Lardner

[57] ABSTRACT

An ammunition cartridge has a casing adapted to hold a primer, a propellant charge, and a subprojectile encased in a multi-piece sabot (launcher). The sabot has, in the immediate vicinity of the subprojectile, an internal annular chamber separated from the propellant charge by a deformable or breakable partition wall having a reduction in its thickness or a groove in a predetermined area. This wall is designed to break away or deform upon firing. The sabot also has an external channel forming an external chamber with the inner wall of the casing. This external chamber is separated from the internal annular chamber by a single elongated external wall.

13 Claims, 2 Drawing Sheets

SABOT WITH CONTROLLED SEPARATION OF THE ELEMENTS FOR SUBCALIBER PROJECTILES

BACKGROUND OF THE INVENTION

The present invention relates to munitions for weapons of small, medium and large caliber, and more particularly to an improved launcher with controlled separation of elements, for munitions of the type including a subcaliber bullet and a launcher, especially for hunting weapons.

In the weapons field, munitions are known which have a subcaliber projectile, combining a subprojectile and a launcher, the essential function of which is to propel the subprojectile at the desired velocity.

The launching techniques currently employed frequently use a launcher formed by two or more elements surrounding the subprojectile. The launcher elements, fitted together with contiguous planes by a locking system, may be made of metal alloys or of plastic. After firing, the aerodynamic forces exerted on the projectile on leaving the weapon cause the launcher elements to separate, from the front toward the rear, thus releasing the subprojectile. This separation of the launcher may be accelerated if the projectile is given a low rotational velocity resulting, for example, from the use of a weapon with a rifled tube. The launcher elements, after separation, each follow their own trajectory and fall at varying distances from the weapon.

For example, Patent No. FR-A-2,555,728 describes a munition for a hunting weapon including a fin-stabilized subcaliber projectile and including a dense-alloy tapered bullet and a plastic launcher.

However, this launching technique, with separation of the launcher from the front toward the rear, has many drawbacks. First of all, the ballistics of the launcher elements are not controlled and, consequently, may present a risk for persons who are near the firer. Moreover, the separation of the launcher elements may disturb the trajectory of the subprojectile, bearing on the latter during separation; this results in a greater ballistic dispersion of the subprojectile.

Patents FR-A-2,599,828 and FR-A-2,606,500 describe hunting bullets of the type including a subprojectile and a launcher made of several detachable elements, the characteristics of which are improved. Thus, Patent FR-A-2,599,828 describes a bullet having great stability of the trajectory, and therefore providing good firing accuracy, but becoming destabilized beyond a certain distance.

Patent FR-A-2,606,500 relates to a munition providing a high initial velocity and limiting the violence of the recoil shock, constituted by a subcaliber bullet and a launcher with the caliber of the weapon, including an open outer annular chamber which is separated from the propellent charge by a partition wall capable of breaking under the pressure of the gases generated by the combustion of the charge and is only delimited toward the outside by the wall of the cartridge case. This device has the advantage of reducing the recoil shock felt by the firer and, for the same pressure, of increasing the initial velocity of the projectile.

However, this outer annular expansion chamber does not make it possible to modify the direction of opening, from the front toward the rear, of the launcher elements during separation on leaving the weapon but, on the contrary, the risk of disturbing the trajectory of the bullet during separation of the launcher elements may be increased.

U.S. Pat. No. 5,182,419 describes a subprojectile combined with a one-piece launching sabot for a rifled-barrel military weapon mounted on an aircraft. The object of this device is to keep the launching sabot on a stable trajectory in order to prevent any impact with the aircraft's jet engines after separation of the subprojectile.

SUMMARY OF THE INVENTION

The subject of the present invention is a device comprising a launcher combined with a subprojectile, providing a high initial velocity while at the same time limiting the recoil shock, and causing opening from the rear toward the front of the launcher elements, ensuring rapid and controlled ejection of its elements by the conjugate effects of the aerodynamic forces and of the expansion of the propellent gases.

The launcher according to the present invention is therefore suitable for munitions of the type including a subprojectile, in particular a subcaliber bullet, and a launcher made of several detachable elements, fitting onto the subprojectile, and it is distinguished in that it includes, in the immediate vicinity of its rear part, a wall forming, with the surface of the subprojectile, an internal annular chamber separated from the propellent charge by a deformable or breakable partition wall.

The device in accordance with the present invention provides the following advantages:

- the separation of the launcher elements causes virtually no disturbance on the subcaliber bullet, since the launcher elements do not bear on the subcaliber bullet;
- the ballistic dispersion of the subcaliber bullet is decreased and the firing accuracy is therefore improved;
- the separation or ejection of the launcher elements is governed and controlled, thereby improving safety;
- the launcher elements do not interfere with the finning of the subcaliber bullet during separation.

The device in accordance with the present invention is applicable in all munitions, of small, medium or large caliber, of the type including a subcaliber projectile, for example a subcaliber bullet, and a launcher consisting of at least two detachable elements, in the field of hunting, sporting or military weapons and, preferably, in the field of hunting weapons.

This device is inserted into an assembly constituted by a cartridge which is composed of

- a primed case;
- a propellent powder charge;
- a complete round comprising a full-caliber launcher and a subcaliber bullet.

The launcher comprises several detachable elements, and preferably two elements, of cylindrical shape, matching, at least in part, the external shape of the subcaliber bullet. When they are fitted onto the subcaliber bullet, these elements are mutually contiguous and form a cylinder which is fastened to the case by at least part of its external surface. Each of the launcher elements may itself be divided into several subelements along the longitudinal axis of the bullet.

The launcher may be made, using conventional techniques, of a metal alloy or of a plastic having the required physical properties, for example nylon.

The subcaliber bullet is preferably a fin-stabilized flechette bullet of known type and made of metal or metal alloy, of organic-metal hybrid alloy or else of reinforced plastic in the case of training munitions.

The internal annular chamber provided in accordance with the invention in the rear part of the launcher is preferably a closed chamber when the elements are fitted and installed on the subcaliber bullet. According to one embodiment, however, the internal annular chamber may be partially open and include, for example, an opening directed toward the rear of the bullet.

As indicated hereinabove, the internal annular chamber is delimited on its rear part by a deformable or breakable partition wall which separates it from the propellent powder charge contained in the case of the complete round. This partition wall is designed so as to deform or break under the pressure of the propellent gases immediately after ignition of the powder. This result may be obtained simply by reducing the thickness of the partition wall in a defined area, or by an appropriate groove, so as to embrittle the partition wall.

In accordance with one embodiment of the invention, it may be advantageous to provide, in the rear part of the launcher, an external channel which has a triangular and very elongate section, separated from the internal annular chamber by a single wall.

According to an alternative embodiment, the internal annular chamber in accordance with the invention may be combined with an annular outer chamber of known type, as described, for example, in Patent FR-A-2,606,500 and located in the immediate vicinity of the internal annular chamber, in the rear part of the launcher.

Thus, during the launching phase, after ignition of the propellent powder, the gases exert an increasing pressure on the entire rear surface of the complete round and, in particular, on the partition wall separating the internal annular chamber. When the pressure reaches a value P, this partition wall deforms or breaks along the demarcations made by means of a thickness reduction or of a groove, and the propellent gases then penetrate into the internal annular chamber.

On leaving the tube of the weapon, the forces exerted on the subcaliber bullet and the launcher are as follows:

- the expansion forces Pb of the propellent gases trapped in the annular chamber, between the external surface of the subcaliber bullet and the launcher, which have the effect of separating the launcher elements from the rear toward the front;
- the forces linked with the aerodynamic pressure Pa exerted on the head of the body of the bullet, which tend to open the launcher elements from the front;
- the aerodynamic forces Fa on the front face of the launcher elements, the shape of which is such that these forces tend to retain the front opening of the launcher elements.

Since the expansion forces Pb of the gases in the annular chamber are greater than the algebraic sum of the aerodynamic forces Fa and of those related to the aerodynamic pressure Pa, the separation of the launcher elements then takes place from the rear toward the front.

According to a preferred embodiment, the front part located at the front of the launcher elements is arranged so as to project slightly from the head of the subcaliber bullet. This results, during the separation of the elements from the subcaliber bullet, in a tipping movement which makes it easier for the rear part of the launcher elements to separate from the rear toward the front.

The device according to the present invention has many advantages compared to the known technique.

Thus, the "separation" shocks of the launcher on leaving the weapon tube are very small since the launcher elements do not bear on the subcaliber bullet during their separating movement. This makes it possible to reduce to a maximum the perturbations which the subcaliber bullet could experience at the start of the trajectory.

Furthermore, the device of the invention improves the ballistic dispersion of the subcaliber bullet. Experiments carried out have shown that this reduction may be approximately 20% compared to a flechette bullet having a launcher of known type, such as the bullet described in Patent FR-A-2,555,728.

Moreover, the governing and control of the separation and/or ejection of the launcher elements make it easier to adjust the opening cone of these elements by the usual means. For example, experiments carried out on bullets equipped with the device of the present invention have shown that, by varying the forces linked with the aerodynamic pressure Pa, the aerodynamic forces Fa and the forces Pb generated by the expansion of the propellent gases, a variation in the opening cone of the launcher elements lying between 10° and 35° approximately is obtained.

Finally, the device according to the invention makes possible the use of wide-spanned finning without leading to interference between the launcher elements and the finning during separation of the elements.

The device of the invention furthermore has the advantage of being compatible with the device with an open outer annular chamber described in Patent FR-A-2,606,500, and in this case, in addition to the advantages mentioned hereinabove, a marked reduction in the recoil shock felt by the firer is also obtained, together with an increase in the initial velocity of the bullet, for the same pressure.

BRIEF DESCRIPTION OF THE DRAWINGS

The various characteristics and advantages of the present invention will be more clearly apparent in the following description relating to preferred embodiments, with reference to the appended drawings, where.

DETAILED DESCRIPTION OF THE DRAWINGS

Figure 1:
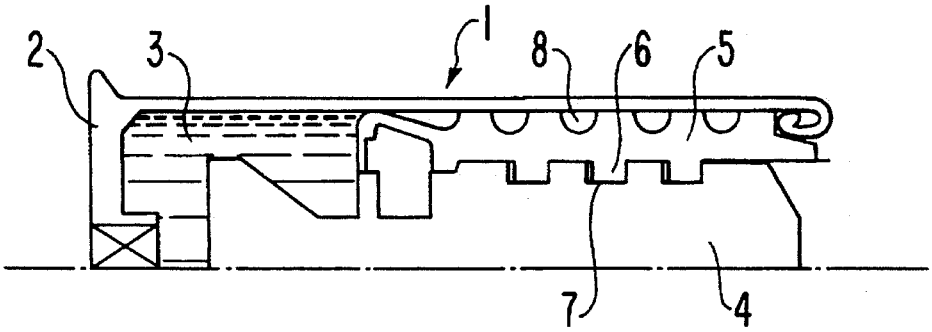
FIG. 1 is a cross-sectional view in half section of a complete round in accordance with the invention, showing a subcaliber bullet and a launcher.

The cartridge (1) depicted in FIG. 1 comprises a primed case (2), a propellent powder charge (3) and the complete round constituted by the subcaliber bullet (4) and the launcher (5) made of two identical elements which are arranged symmetrically with respect to the longitudinal axis of the bullet and can separate longitudinally.

On its inner face, the launcher (5) includes keys (6) interacting with circular grooves (7) made in the surface of the subcaliber bullet (4), making it easier to install the launcher and ensuring the mechanical integrity of the assembly in the weapon tube during the launching phase.

On its external surface, the launcher (5) has annular channels (8) intended to ensure good sealing during the launching phase, these acting as decompression channels. These annular channels (8) also have the effect of limiting the frictional surface area in the tube and of enabling highly choked weapons to be used.

Figure 2:
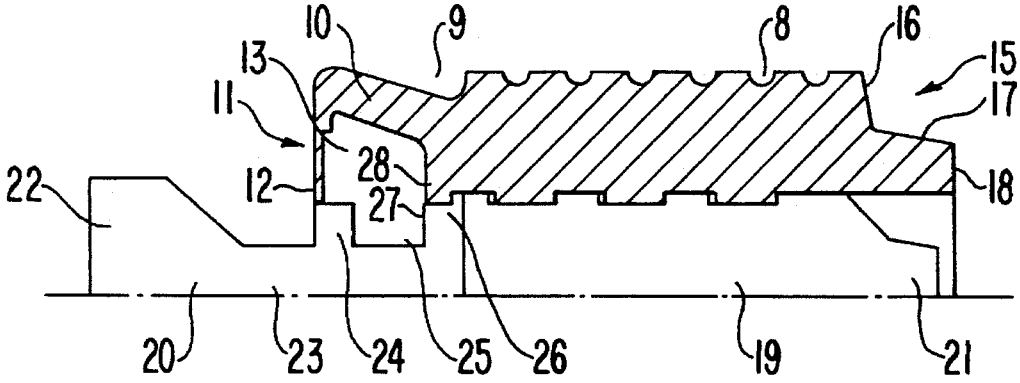
FIG. 2 is a cross-sectional view in half section showing the position of the launcher installed on the subcaliber bullet.

As shown more clearly in FIG. 2, the launcher includes, in its rear part, an external channel (9) which has a triangular and very elongate section, making it possible to ensure flexibility of the part (10) when passing through the choke of the tube.

The rear part of the launcher (5) also includes, at its rear face (11), a partition wall (12) which delimits, with the internal face of the part (10) and the surface of the subcaliber bullet (4), an internal annular chamber (13) of substantially trapezoidal section.

Figure 3:
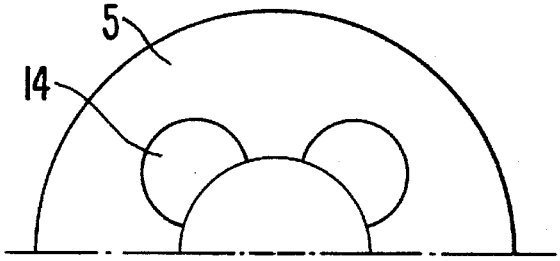
FIG. 3 is a half view from the front, showing the rear part of the launcher of FIG. 2.

The partition wall (12) includes areas of reduced thickness forming lunes (14) of rounded shape, these being depicted in FIG. 3. These lunes, which are weaker than the other parts of the launcher (5), are deformed and broken during the rise in pressure of the propellent gases which then penetrate into the internal annular chamber (13). The expansion force thus created is exerted on the internal face of the part (10) and tends to push the entire launcher outward.

The front part (15) of the launcher (5), depicted in FIG. 2, comprises a peripheral face (16) substantially perpendicular to the axis of the bullet (4), an external conical part (17) and a central face (18) likewise perpendicular to the axis of the bullet.

The subcaliber bullet (4) consists of a bullet body (19), for example made of a lead alloy, and of a finned part (20) which may be made of plastic. The body (19) of the subcaliber bullet includes circular grooves (7), formed perpendicularly to the axis of the bullet (4), interacting with the keys (6) of the launcher (5).

The head (21) of the bullet body (19) has a substantially biconical shape and is placed slightly set back from the central face (18) of the launcher (5).

The finned part (20) fixed to the rear of the bullet body (19) comprises the fin (22) provided with four wings formed on the fin body (23). The latter includes a cylindrical rib (24) of external diameter equal to the internal diameter of the partition wall (12) that includes the lunes (14), in such a way that, when the launcher (5) is installed on the subcaliber bullet (4) in the cartridge, good sealing is ensured on the one hand between the launcher (5) and the internal wall of the case (2) and, on the other hand, between the launcher (5) and the subcaliber bullet (4) in the region of the interface between the partition wall (12) and the cylindrical rib (24).

An external circular recess (25) in front of the rib (24) in the fin body (23) makes it possible, in this embodiment, to increase the volume of the annular chamber (13). Moreover, the fin body also includes a second cylindrical rib (26) having a shoulder (27) which interacts with the first external key (28) of the launcher (5).

Figure 4:
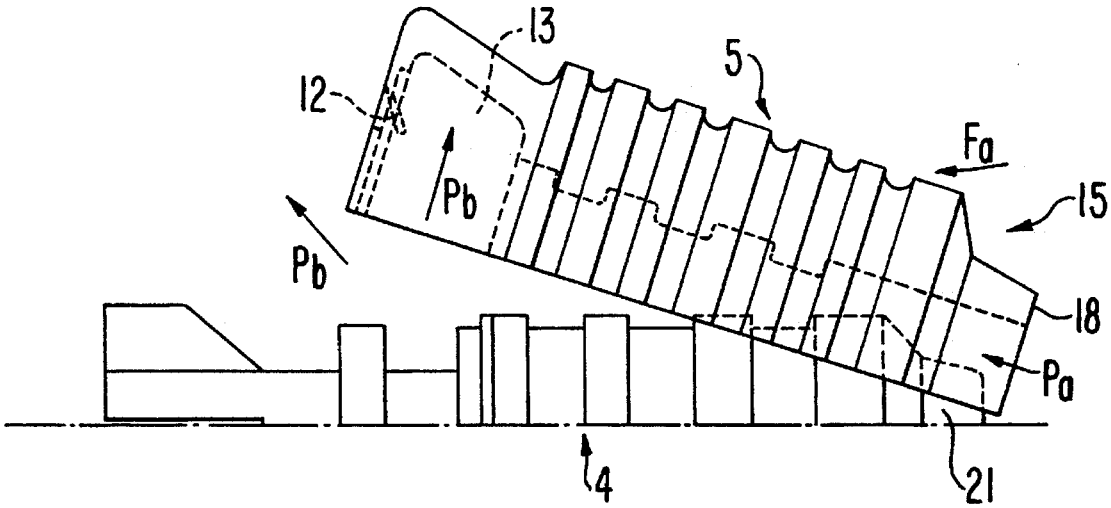
FIG. 4 is a half view from the side, showing the position of a launcher element with respect to the subcaliber bullet, during separation.

As shown in FIG. 4, with the partition wall (12) having been pushed back by the expansion of the propellent gases, the launcher (5) elements separate from the subcaliber bullet (4), on leaving the weapon tube, in a tipping movement from the rear toward the front, under the action of the expansion forces Pb of the propellent gases in the annular chamber (13), which forces are greater than the sum of the aerodynamic forces Fa exerted on the front part (15) of the launcher (5) and the forces linked with the aerodynamic pressure Pa exerted in the cavity formed by the biconical head (21) of the bullet (4) and the central face (18) of the launcher (5).

Figure 5:
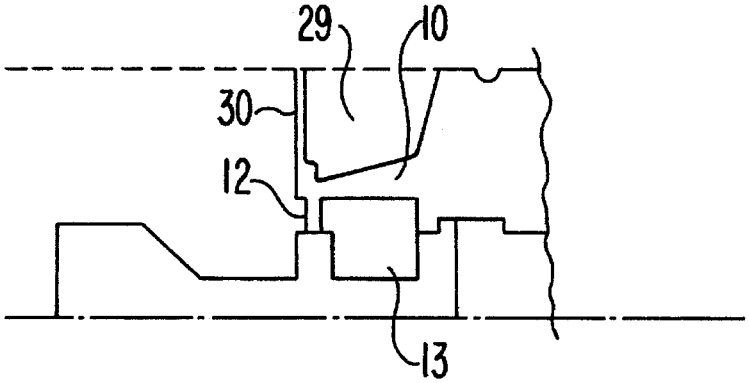
FIG. 5 is a partial view, in section, of an alternative embodiment of the annular chamber of the launcher.

The alternative embodiment depicted in FIG. 5 shows the combination of the internal annular chamber (13) with an external annular chamber (29). In this case, the partition wall (12) has a lower height and is extended, on the other side of the rear part (10), by a second partition wall (30) delimiting the external annular chamber (29). This annular chamber (29) is open to the outside. This opening is concealed by the wall of the case before ignition, and then by the internal wall of the weapon tube in the first launching phase. The partition wall (30) is broken at the same time as the partition wall (12) by the rise in pressure of the propellent gases.

The front part of the launcher (5) elements may have a shape different from that depicted in FIG. 2 depending on the effects desired, using known techniques.

The invention has been described with reference to a hunting bullet. Of course, it applies in a similar manner to any munition of small, medium or large caliber.

I claim:

1. A sabot for encasing a subprojectile in an ammunition casing holding a propellant charge, and wherein the sabot separates into multi-pieces upon being discharged out of a firearm, comprising:

a main body having a leading end and a trailing end;

an elongated external wall extending from the trailing end, wherein an external channel is formed between the external wall and the trailing end of the main body to enable the external wall to be flexible and wherein the external wall is adapted to contact an inner wall of the casing;

a partition wall extending inwardly from the elongated external wall, substantially perpendicularly to the main body, wherein the elongated wall, the partition wall and an outer surface of the subprojectile form an internal annular chamber, the partition wall separating the internal annular chamber from the propellant charge, and wherein the elongated external wall and the external channel form an external chamber, the elongated wall separating the inner and outer chambers, and wherein the partition wall is breakable upon igniting the propellant charge to trap gases produced therein, which gases cause separation of the sabot upon being discharged.

2. A sabot according to claim 1, wherein the leading end of the main body leads slightly ahead of a leading end of the subprojectile.

3. A sabot according to claim 1, wherein the partition wall has an area with reduction in thickness to form a frangible area.

4. A sabot according to claim 1, wherein the partition wall has an area with a groove to form a frangible area.

5. A sabot according to claim 1, wherein the sabot is symmetrically divided longitudinally into two pieces.

6. A sabot according to claim 1, wherein the internal annular chamber is adapted to be closed upon the sabot encasing the subprojectile and encased in the casing.

7. A sabot according to claim 1, wherein the internal annular chamber is adapted to be partially open.

8. A sabot for encasing a subprojectile in an ammunition casing holding a propellant charge, and wherein the sabot separates into multi-pieces upon being discharged out of a firearm, comprising:

a main body having a leading end and a trailing end;

an elongated external wall extending from the trailing end, wherein an external channel is formed between the external wall and the trailing end of the main body to enable the external wall to be flexible and wherein the external wall is adapted to contact an inner wall of the casing;

a partition wall extending inwardly from the elongated external wall, substantially perpendicularly to the main body, wherein the elongated wall, the partition wall and an outer surface of the subprojectile form an internal annular chamber, the partition wall separating the internal annular chamber from the propellant charge, and wherein the elongated external wall and the external channel form an external chamber, the elongated wall separating the inner and outer chambers, and wherein the partition wall is deformable upon igniting the propellant charge to trap gases produced therein, which gases cause separation of the sabot upon being discharged.

9. A sabot according to claim 8, wherein the leading end of the main body leads slightly ahead of a leading end of the subprojectile.

10. A sabot according to claim 8, wherein the sabot is symmetrically divided longitudinally into two pieces.

11. A sabot according to claim 8, wherein the internal annular chamber is adapted to be closed upon the sabot encasing the subprojectile and encased in the casing.

12. A sabot according to claim 8, wherein the internal annular chamber is adapted to be partially open.

13. An ammunition cartridge comprising:

a case holding a primer and a propellent charge;

a subprojectile having leading end and a trailing end; and a sabot encasing the subprojectile and seated in the case, wherein the sabot separates into multipieces upon being discharged out of a firearm, the sabot comprising:

a main body having a leading end and a trailing end;

an elongated external wall extending from the trailing end, wherein an external channel is formed between the external wall and the trailing end of the main body to enable the external wall to be flexible and wherein the external wall contacts an inner wall of the casing;

a partition wall extending inwardly from the elongated external wall, substantially perpendicularly to the main body, wherein the elongated wall, the partition wall and an outer surface of the subprojectile form an internal annular chamber, the partition wall separating the internal annular chamber from the propellant charge, and wherein the elongated external wall and the external channel form an external chamber, the elongated wall separating the inner and outer chambers, and wherein the partition wall is breakable upon igniting the propellant charge to trap gases produced therein, which gases cause separation of the sabot upon being discharged.

* * * * *